US007867439B2

(12) United States Patent
Oechsle et al.

(10) Patent No.: US 7,867,439 B2
(45) Date of Patent: Jan. 11, 2011

(54) PROCESS FOR PRODUCING DISPERSOID-STRENGTHENED MATERIAL

(75) Inventors: Michael Oechsle, Salach (DE); Stefan Zeuner, Bad Homburg (DE)

(73) Assignee: Umicore AG & Co., KG, Hanau-Wolfgang (DE)

( * ) Notice: Subject to any disclaimer, the term of this patent is extended or adjusted under 35 U.S.C. 154(b) by 718 days.

(21) Appl. No.: 11/661,022

(22) PCT Filed: Aug. 24, 2005

(86) PCT No.: PCT/EP2005/009144

§ 371 (c)(1),
(2), (4) Date: Aug. 17, 2007

(87) PCT Pub. No.: WO2006/021438

PCT Pub. Date: Mar. 2, 2006

(65) Prior Publication Data

US 2008/0102301 A1 May 1, 2008

(30) Foreign Application Priority Data

Aug. 26, 2004 (DE) ..... 10 2004 041 404
Aug. 26, 2004 (DE) ..... 10 2004 041 406

(51) Int. Cl.
*B22F 1/00* (2006.01)

(52) U.S. Cl. ..... 419/62; 419/66; 419/10; 419/19; 428/546

(58) Field of Classification Search ..... 419/62
See application file for complete search history.

(56) References Cited

U.S. PATENT DOCUMENTS 3,440,042 A * 4/1969 Kaufmann ..... 419/19
3,489,553 A * 1/1970 Duletsky ..... 419/20
4,018,559 A * 4/1977 Retzsch ..... 8/94.2
4,018,630 A * 4/1977 Hill et al. ..... 419/21
2002/0112563 A1 8/2002 Shoji et al.

FOREIGN PATENT DOCUMENTS

WO WO 8100977 A * 4/1981

OTHER PUBLICATIONS

Carl Koch, "Milling of Brittle and Ductile Materials," ASM Handbook, vol. 7, 1998, pp. 53-66.*
International Search Report (PCT/EP2005/009144).
Written Opinion (PCT/EP2005/009144).

* cited by examiner

*Primary Examiner*—Roy King
*Assistant Examiner*—Christopher Kessler
(74) *Attorney, Agent, or Firm*—Kalow & Springut LLP; William D. Schmidt

(57) ABSTRACT

In a first embodiment the invention relates to a process for producing a dispersoid-strengthened material, comprising the steps of: (i) providing metal particles, wherein the metal is selected from platinum group metals, gold, silver, nickel and copper, as well as alloys thereof; (ii) mixing the metal particles with a precursor compound of the dispersoid and solvent; (iii) removing the solvent, so as to obtain metal particles provided with precursor compound; and (iv) compacting the metal particles provided with precursor compound in order to obtain the dispersoid-strengthened material, wherein the precursor compound is converted into the dispersoid during the compacting operation. In a second embodiment the invention relates to a process for producing a dispersoid-strengthened material, comprising the steps of: (i) providing metal particles, wherein the metal is selected from platinum group metals, gold, silver, nickel and copper, as well as alloys thereof, and wherein the metal particles are produced by mechanical processes selected from machining, milling, turning and filing; (ii) mixing the metal particles with a dispersoid or a precursor compound of the dispersoid, as well as solvent; removing the solvent; and compacting the metal particles obtained in step (iii) in order to obtain the dispersoid-strengthened material.

9 Claims, No Drawings

PROCESS FOR PRODUCING DISPERSOID-STRENGTHENED MATERIAL

FIELD OF INVENTION

The invention relates to processes for producing dispersoid-strengthened material.

BACKGROUND OF THE INVENTION

Certain precious metals, such as in particular platinum group metals, gold and silver, despite their excellent chemical stability, are only suitable for a limited number of applications, since their mechanical properties are unsatisfactory. One possible way of improving the mechanical properties, such as the strength at elevated temperatures, is dispersoid-strengthening, which is also known as "dispersion-strengthening". In the materials obtained, the improvement in the mechanical properties is based on the combination of the precious metal with non-metallic particles (the dispersoids) finely distributed therein, which allow the structured matrix to be stabilized. The structure of the matrix is obtained by deformation during the production of the precursor material.

There are a range of known processes which allow dispersion-strengthened materials to be produced. One of the earliest processes was the powder metallurgical method, in which dispersion-strengthened materials were produced by mixing metal powders with finely distributed refractory particles and then compacting the mixture. Further processes are spray processes, such as the method described in GB-B 1 280 815, and internal oxidation, which is disclosed, for example, in DE-A 178 30 74.

However, these known processes have the drawback of being complicated and expensive. Furthermore, they require the use of elevated temperatures or controlled working atmospheres. Consequently, there is a demand for a process which can produce dispersoid-strengthened materials in a simple and inexpensive way.

SUMMARY OF THE INVENTION

In a first embodiment the invention relates to a process for producing a dispersoid-strengthened material, comprising the steps of:

(i) providing metal particles, wherein the metal is selected from platinum group metals, gold, silver, nickel and copper, as well as alloys thereof;

(ii) mixing the metal particles with a precursor compound of the dispersoid and solvent;

(iii) removing the solvent, so as to obtain metal particles provided with precursor compound; and (iv) compacting the metal particles provided with precursor compound in order to obtain the dispersoid-strengthened material, wherein the precursor compound is converted into the dispersoid during the compacting operation.

In a second embodiment the invention relates to a process for producing a dispersoid-strengthened material, comprising the steps of:

(i) providing metal particles, wherein the metal is selected from platinum group metals, gold, silver, nickel and copper, as well as alloys thereof, and wherein the metal particles are produced by mechanical processes selected from machining, milling, turning and filing;

(ii) mixing the metal particles with a dispersoid or a precursor compound of the dispersoid, as well as solvent;

(iii) removing the solvent; and (iv) compacting the metal particles obtained in step (iii) in order to obtain the dispersoid-strengthened material.

Combinations of these two embodiments are, of course, also possible. Furthermore, one or both of the processes can be combined with conventional processes.

The invention also relates to dispersoid-strengthened material obtainable by this process.

DETAILED DESCRIPTION OF THE PREFERRED EMBODIMENTS

First of all, in step (i) of the process, metal particles are provided. The metal may be selected from platinum group metals, gold, silver, nickel and copper, as well as alloys thereof. The metal used is preferably a platinum group metal or an alloy containing platinum group metal. Platinum and platinum-containing alloys, such as platinum, platinum-rhodium alloys, platinum-iridium alloys and platinum-gold alloys, are particularly preferred.

In the first embodiment, the particles consisting of the metals can be produced in any desired way. Examples of possible ways of producing metal particles from compact metal parts are, in addition to thermal processes, such as atomizing and flame spraying, also chemical processes, such as precipitation processes, and mechanical processes, such as machining, milling, turning and filing. Among these, for the reasons stated below, mechanical processes are preferred.

In the second embodiment the metal particles are produced from compact metal parts by mechanical processes, such as machining, milling, turning and filing. These processes, unlike thermal processes, such as atomization and flame spraying, or mechanical processes, such as milling, lead to an irregular surface structure on the metal particles and to a high dislocation density in the material. The vacancies, which result in the material, lead to particularly advantageous properties, such as a particularly high creep rupture strength.

The metal particles may be of any suitable size. However, they are generally of a size from 10 μm to 10 mm, preferably from 20 μm to 5 mm.

In the first embodiment of the invention, the metal particles are then mixed with a precursor compound of the dispersoid and solvent. In the second embodiment of the invention the metal particles can be alternatively mixed with a dispersoid and solvent.

The precursor compound of the dispersoid may be in the form of solid particles in the solvent (i.e., in the form of a suspension) or may be dissolved in the solvent.

Suitable dispersoids for the dispersoid-strengthened material are all known dispersoids. These include, inter alia, compounds of elements from groups IIA, IIIA, IVA, IIB, IIIB, IVB and VB of the Periodic System (IUPAC 1985) or of the lanthanide group, as well as mixtures of compounds of these elements. Dispersoids based on zirconium, yttrium, thorium, hafnium, calcium, magnesium, aluminium, silicon and mixtures of these dispersoids are preferred, with dispersoids based on zirconium, yttrium, thorium, hafnium, calcium, magnesium and mixtures of these dispersoids being particularly preferred. The dispersoids may be in the form of oxides and nitrides, but in particular in the form of oxides.

Suitable precursor compounds of these dispersoids are all compounds which are converted into the dispersoid during the compacting in step (iv) of the process according to the invention, either directly or, as described below, after conversion into a further precursor compound. The precursor compound should preferably be completely converted into the dispersoid or converted so as to form the dispersoid and a volatile material, for example a gas or a highly volatile substance (e.g., a substance which is volatilized out of the precursor of the material under the conditions used in step (iv)). Suitable precursor compounds of the dispersoid are nitrates, oxalates, acetates, hydroxides, carbonates and hydrogen carbonates, in particular carbonates and hydrogencarbonates.

In the first embodiment of the invention, if the dispersoid-strengthened material contains mixtures of dispersoids, it is not imperative that all the dispersoids be introduced by means of a precursor compound using the process according to the first embodiment of the invention. Rather, it is possible for one or more dispersoids to be introduced using the first embodiment of the invention and one or more dispersoids to be introduced into the material in some other way. This also applies to the second embodiment of the invention if the metal particles are mixed with a precursor compound and solvent in step (ii).

In the second embodiment of the invention it is furthermore possible to select a precursor compound of a dispersoid which is converted into the desired dispersoid in step (ii) or step (iii) of the process according to the second embodiment of the invention. Examples of precursor compounds which can be converted into the desired dispersoid in step (ii) of the process according to the second embodiment of the invention are all compounds which can be precipitated, for example, onto the metal particles. One such example is calcium carbonate. Precursor compounds of the dispersoid can also be converted into the dispersoid in step (iii) of the process according to the second embodiment of the invention. Suitable precursor compounds in this case are all compounds which are converted into the desired dispersoid when the solvent is removed. In this sub-embodiment, the conversion into dispersoid can also be assisted in particular by elevated temperature.

If the dispersoid-strengthened material contains mixtures of dispersoids, it is possible for one or more dispersoids to be introduced in the form of precursor compounds of the dispersoid and for one or more dispersoids to be introduced into the material already in the form of dispersoids.

If the precursor compound of the dispersoid is in the form of particles in a suspension, the size of the particles of the precursor compound of the dispersoid may influence the size of the dispersoid particles in the final material, and should be selected appropriately. The size of the particles of the precursor compound of the dispersoid will typically be from 1 nm to 50 μm, preferably from 10 nm to 1 μm. This makes it possible to obtain particle sizes of dispersoid in the final material of, for example, 1 nm to 50 μm, preferably from 10 nm to 1 μm.

In the second embodiment of the invention, if the suspension contains a dispersoid which is already in dispersoid form, the size of the particles of the dispersoid in the suspension is typically from 1 nm to 50 μm, preferably from 10 nm to 1 μm. This makes it possible to produce particle sizes of dispersoid in the final material of, for example, from 1 nm to 50 μm, preferably from 10 nm to 1 μm.

In addition to the dispersoid or its precursor compound, the suspension or solution also contains a solvent. The solvent is not particularly restricted. It is preferable to select a solvent which is compatible with occupational safety regulations and environmental protection legislation and can be removed easily and without leaving residues. Examples of such solvents include alcohols (for example $C_{1-4}$ alcohols), water and all other polar solvents. Water is preferred.

The concentration of the dispersoid or precursor compound of the dispersoid in the suspension or solution is not critical. On the one hand, the concentration should be selected to be such that the suspension or solution has a viscosity which is suitable for mixing it with the metal particles. On the other hand, the quantity of solvent should not be selected to be too high, since otherwise the time and/or costs involved in removing the solvent become too high. Suitable concentrations are, for example, in the range from 0.1% to 50%, preferably from 1% to 10%.

The ratio of the amounts of dispersoid or precursor compound of the dispersoid to metal particles in the mixing step is of greater importance than the concentration of the dispersoid or precursor compound of the dispersoid in the suspension or solution. The ratio should be selected in such a way that the desired concentration of the dispersoid in the final material is achieved. The concentration of the dispersoid in the final material is not particularly restricted and depends on the type of dispersoid, the choice of any further dispersoids which may be present, the intended use of the material, etc. Typical concentrations of the dispersoid in the final material are in the range 0.001 to 10% by volume, preferably from 0.01 to 5% by volume, particularly preferably from 0.1 to 5% by volume, based on the total volume of the material.

The metal particles and the suspension or solution can be mixed using any desired process; the intention is that uniform mixing of the metal particles and the dispersoid or precursor compound of the dispersoid should be achieved. One possibility is for the suspension or solution to be sprayed onto the metal particles. A further possibility is for the metal particles and the suspension or solution to be mixed in a mixer, such as an agitator or a kneader.

The conditions which are selected for mixing are not particularly restricted and are typically selected based on the metal particles selected and the constituents selected for the suspension or solution. Ambient conditions (i.e., room temperature (approximately 20 to approximately 30° C.) and air atmosphere) are preferably selected, with a view to making the process cost-effective. However, this is not imperative.

After the metal particles and the suspension or solution have been mixed, the solvent is removed. The processes used to remove the solvent are not particularly restricted. By way of example, the solvent can be removed at room temperature or elevated temperature. It is also possible to remove the solvent under reduced pressure.

After the solvent has been removed, metal particles which have a dispersoid (second embodiment) or a precursor compound of the dispersoid (first or second embodiment) on their surface are obtained.

The precursor compound of the dispersoid present on part or all of the surface of the metal particles may be identical to the precursor compound contained in the suspension or solution or may be a different, further precursor compound. This will be explained on the basis of the embodiments given below. The types of dispersoids and their precursor compounds listed are only intended, however, to make it easier to understand the invention, and are not to be interpreted as constituting any restriction. The embodiments can also be implemented using other dispersoids and other precursor compounds.

According to one sub-embodiment (first embodiment and second embodiment of the invention), the suspension could contain a carbonate compound as a precursor compound. After the solvent has been removed, metal particles provided with carbonate compound are obtained. The carbonate compound is then converted into the desired oxide as a dispersoid.

According to a second sub-embodiment (first embodiment and second embodiment of the invention), by way of example, a hydrogencarbonate compound can be introduced into the suspension as a precursor compound. Removal of the solvent provides metal particles provided with carbonate compound as a further precursor compound. The carbonate compound is then in turn converted into the desired oxide as the dispersoid.

According to a third sub-embodiment (second embodiment of the invention), the suspension contains the desired oxide dispersoid, so that the metal particles are provided with oxide particles on the surface.

According to a fourth sub-embodiment (first embodiment and second embodiment of the invention), a solution of a precursor compound of the dispersoid is mixed with the metal particles. A precipitating agent is added, so that a dispersoid (second embodiment) or precursor compound (first embodiment and second embodiment) of the dispersoid is precipitated onto the metal particles. If a precursor compound of the dispersoid is precipitated on the metal particles, this precursor compound can be converted into the dispersoid in an appropriate subsequent process step.

According to a fifth sub-embodiment (first embodiment and second embodiment of the invention), a solution of a precursor compound of the dispersoid is mixed with the metal particles. When the solvent is removed, for example at elevated temperatures, the dispersoid (second embodiment) or a precursor compound (first and second embodiment) of the dispersoid is precipitated onto the metal particles. If a precursor compound of the dispersoid is precipitated on the metal particles, this precursor compound can be converted into the dispersoid in an appropriate subsequent process step.

The obtained metal particles are then compacted to form the desired dispersoid-strengthened material. The compacting can be carried out using any desired process. In general, a process having at least two stages is carried out. First of all, the metal particles which have been provided with dispersoid or precursor compound are pre-compacted, and then they are compacted further.

The pre-compacting can be carried out, for example, by isostatic or axial pressing. One known process in this respect is cold isostatic pressing. The further compacting is generally carried out at elevated temperatures and if appropriate under a controlled atmosphere (such as nitrogen, hydrogen or argon). Processes which can be used include forging and hot isostatic pressing. The compacting processes are known to a person skilled in the art, for example from Kishor M. Kulkarni, "Powder Metallurgy for Full Density Products", New Perspectives in Powder Metallurgy, Vol. 8, Metal Powder Industries Federation, Princeton, N.J., 08540, 1987.

In the first embodiment of the invention and a sub-embodiment of the second embodiment of the invention, the precursor compound of the dispersoid is converted into the dispersoid during the compacting operation. This can take place during any desired compacting stage in the case of a multi-stage compacting process. When using multi-stage compacting processes, it is preferable for the precursor compound to be converted into the dispersoid during the further compacting, since the temperature of the material is elevated in this stage of the process. If a suitable procedure is used, it is possible to make use of the exothermicity of individual process steps, for example the forging, hot isostatic pressing (HIP), hot-pressing, impact extrusion or hot extrusion, to convert the precursor compound of the dispersoid into the dispersoid.

The procedure of converting the precursor compound of the dispersoid into the dispersoid during the compacting step is particularly advantageous since there is no need for an additional process step to convert the precursor compound of the dispersoid into the dispersoid. This not only simplifies the procedure but also reduces the costs of the process, since there is no need for any additional energy to be supplied for the conversion.

The dispersoid-strengthened materials produced in accordance with the invention can be used in all application areas in which the ability to withstand high temperatures in addition to an extremely high chemical stability are required. Typical areas of use are as construction materials in high-temperature applications and/or in applications which require a high chemical inertness. Examples include melting crucibles and components used in the glass, fluorine and semiconductor industries.

The present invention is illustrated on the basis of the following example. These examples are not, however, intended to restrict the invention, which is defined by the claims.

EXAMPLES

Example 1

Cast ingots of platinum, a platinum-rhodium (10%) alloy and a platinum-gold (5%) alloy, respectively, were filed to produce metal particles by filing. The filing powder was screened to obtain a fraction of less than 1 mm. A suspension of 10% by weight of calcium hydrogencarbonate in distilled water was produced. 1000 g of filing powder and 50 g of suspension were mixed in a kneading mixer until the surface of the filing powder was uniformly covered with the suspension. The water was removed by heating at 120° C., thereby producing metal particles covered with calcium carbonate. The metal particles covered with calcium carbonate were pre-compacted to form a compact body in an isostatic press at room temperature and 4000 bar and then compacted further to form a homogeneous body by forging at 1400° C. The conversion of the calcium carbonate into calcium oxide and carbon dioxide was in this case effected by the process energy released during the further compacting. A 1 mm thick wire was produced from the forged ingot by multi-stage rolling and drawing. The dispersoid constituted 1% by volume of the wire, based on the total volume of the wire.

The wires were in each case subjected to a creep rupture test at 1400° C. for 100 h. The results are given in Table 1.

TABLE 1

| | Metal | | |
|---|---|---|---|
| | Pt | PtRh10 | PtAu5 |
| Creep rupture strength with dispersoid/creep rupture strength without dispersoid | 4 | 1.5 | 2 |

Tests using atomized powder, milling chips and turning chips were likewise carried out with success.

Example 2

Cast ingots of platinum, a platinum-rhodium (10%) alloy and a platinum-gold (5%) alloy, respectively, were filed to produce metal particles by filing. The filing powder was screened to obtain a fraction of less than 1 mm. A solution of 10% by weight of zirconium silicate in water was produced. 1000 g of filing powder and 50 g of solution were mixed in a kneading mixer. Zirconium oxide having a particle size of less than 1 μm was precipitated on the surface of the filing powder by introducing 100 ml of 10% sodium hydroxide solution.

The water was removed by heating at 120° C., thereby producing metal particles covered with zirconium oxide. The metal particles covered with zirconium oxide were pre-compacted to form a compact body at 4000 bar in an isostatic press and then compacted further to form a homogeneous body by forging at 1400° C. A 1 mm thick wire was produced from the forged ingot by multi-stage rolling and drawing. The dispersoid constituted 1% by volume of the wire, based on the total volume of the wire.

The wires were in each case subjected to a creep rupture test at 1400° C. for 100 h. The results are given in Table 2.

TABLE 2

| | Metal | | |
|---|---|---|---|
| | Pt | PtRh10 | PtAu5 |
| Creep rupture strength with dispersoid/creep rupture strength without dispersoid | 5 | 2 | 3 |

Tests using milling chips and turning chips were likewise carried out with success.

Example 3

Cast ingots of platinum, a platinum-rhodium (10%) alloy and a platinum-gold (5%) alloy, respectively, were filed to produce metal particles by filing. The filing powder was screened to obtain a fraction of less than 1 μm. A suspension of 2% by weight of hafnium oxide, 2% by weight of calcium oxide, 2% by weight of magnesium oxide, 2% by weight of yttrium oxide and 2% by weight of zirconium oxide in water was produced. The size of the particles was in each case at most 1 μm. 1000 g of filing powder and 50 g of suspension were mixed in a kneading mixer until the surface of the filing powder was uniformly covered with the suspension. The water was removed by heating at 120° C., thereby producing metal particles covered with dispersoid mixture. The metal particles obtained were pre-compacted to form a compact body at 4000 bar in an isostatic press and compacted further to form a homogeneous body by forging at 1400° C. A 1 mm thick wire was produced from the forged ingot by multi-stage rolling and drawing. The dispersoid constituted 1.5% by volume of the wire, based on the total volume of the wire.

The wires were in each case subjected to a creep rupture test at 1400° C. for 1000 h. The results are given in Table 3.

TABLE 3

| | Metal | | |
|---|---|---|---|
| | Pt | PtRh10 | PtAu5 |
| Creep rupture strength with dispersoid/creep rupture strength without dispersoid | 6 | 3 | 4 |

Tests using milling chips and turning chips were likewise carried out with success.

What is claimed is:

1. Process for producing a dispersoid-strengthened material comprising the steps of:

(i) providing metal particles having a size of 20 μm to 5 mm, wherein the metal is selected from the group consisting of platinum group metals, gold, silver, nickel and copper, as well as alloys thereof;

(ii) mixing the metal particles with a precursor compound of the dispersoid and solvent, wherein the precursor compound is in the form of particles in a suspension;

(iii) removing the solvent, so as to obtain metal particles provided with precursor compound; and (iv) compacting the metal particles provided with the precursor compound in order to obtain the dispersoid-strengthened material, wherein the precursor compound is converted into the dispersoid during the compacting operation.

2. Process according to claim 1, wherein the precursor compound is selected from the group consisting of carbonates and hydrogen carbonates.

3. Process according to claim 1, wherein the metal is selected from the group consisting of platinum group metals and alloys which contain platinum group metal.

4. Process according to claim 1, wherein the dispersoid comprises one or more oxides.

5. Process according to claim 1, wherein the dispersoid contains one or more compounds which comprise an element selected from the group consisting of groups IIA, IIIA, IVA, IIB, IIIB, IVB and VB and the lanthanide group of the Periodic System.

6. Process according to claim 1, wherein the dispersoid is selected from the group consisting of calcium oxide, magnesium oxide, hafnium oxide, yttrium oxide, zirconium oxide and mixtures thereof.

7. Process according to claim 1, wherein the dispersoid is present in the material in an amount of from 0.001 to 5% by volume, based on the total volume of the material.

8. Process according to claim 1, wherein the mixing in step (ii) is carried out by mixing under ambient conditions.

9. Process according to claim 1, wherein the compacting is carried out in at least two stages.

* * * * *